United States Patent [19]

Holland

[11] 4,236,433

[45] Dec. 2, 1980

[54] ELECTRIC STRING INSTRUMENT

[76] Inventor: Stephen Holland, 80 Madison Ave., Watertown, Mass. 02172

[21] Appl. No.: 25,784

[22] Filed: Apr. 2, 1979

[51] Int. Cl.[3] ..... G10H 3/00

[52] U.S. Cl. ..... 84/1.16; 84/1.05; 84/DIG. 10

[58] Field of Search ..... 84/1.16, DIG. 10, 1.05, 84/1.14, 1.15

[56] References Cited

U.S. PATENT DOCUMENTS

| | | | |
|---|---|---|---|
| 472,019 | 3/1892 | Ohmart | 84/1.05 |
| 1,002,036 | 8/1911 | Clement | 84/1.05 |
| 2,401,372 | 6/1946 | Rienstra | 84/1.05 |
| 2,578,620 | 12/1951 | Wilhelm | 84/1.16 |
| 2,920,522 | 1/1960 | DeArmond | 84/1.16 |
| 3,185,755 | 5/1965 | Williams et al. | 84/1.16 |
| 3,524,375 | 8/1970 | Hopping | 84/1.16 |
| 3,742,113 | 6/1973 | Cohen | 84/1.16 |
| 4,075,921 | 2/1978 | Heet | 84/1.16 |

*Primary Examiner*—J. V. Truhe

*Assistant Examiner*—Forester W. Isen

*Attorney, Agent, or Firm*—Wolf, Greenfield & Sacks

[57] ABSTRACT

The guitar has a novel feedback arrangement for sustaining the sound generated from the strings and including a pickup associated with each string and a corresponding driver intercoupled with the pickup in a feedback loop that also includes a gain-controlled amplifier. The amplifiers are controlled in common from a variable control means. The pickups, drivers and associated electronics are all commonly mounted from the bridge. In an alternate embodiment of the invention there is provided an improved sustain technique that provides a more natural sustain characteristic, employing a parametric type of excitation. This embodiment may comprise a pickup, amplifier and tensioning member responsive to the output of the amplifier for sustaining string vibration by causing longitudinal string displacement by means of the tensioning member. In a similar embodiment the string tension may be held constant and the string length varied instead.

15 Claims, 11 Drawing Figures

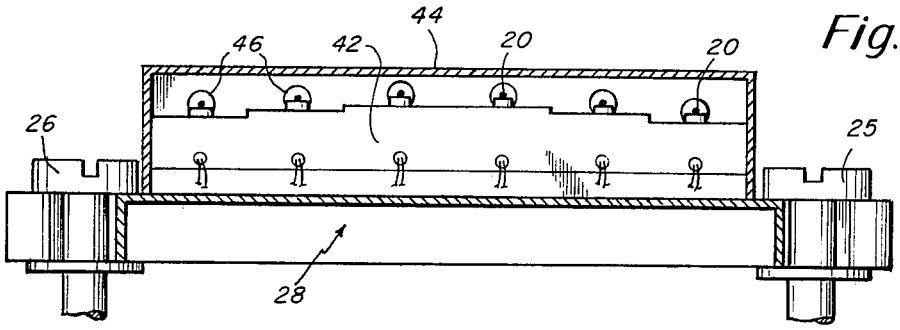
Fig. 4
Fig. 5
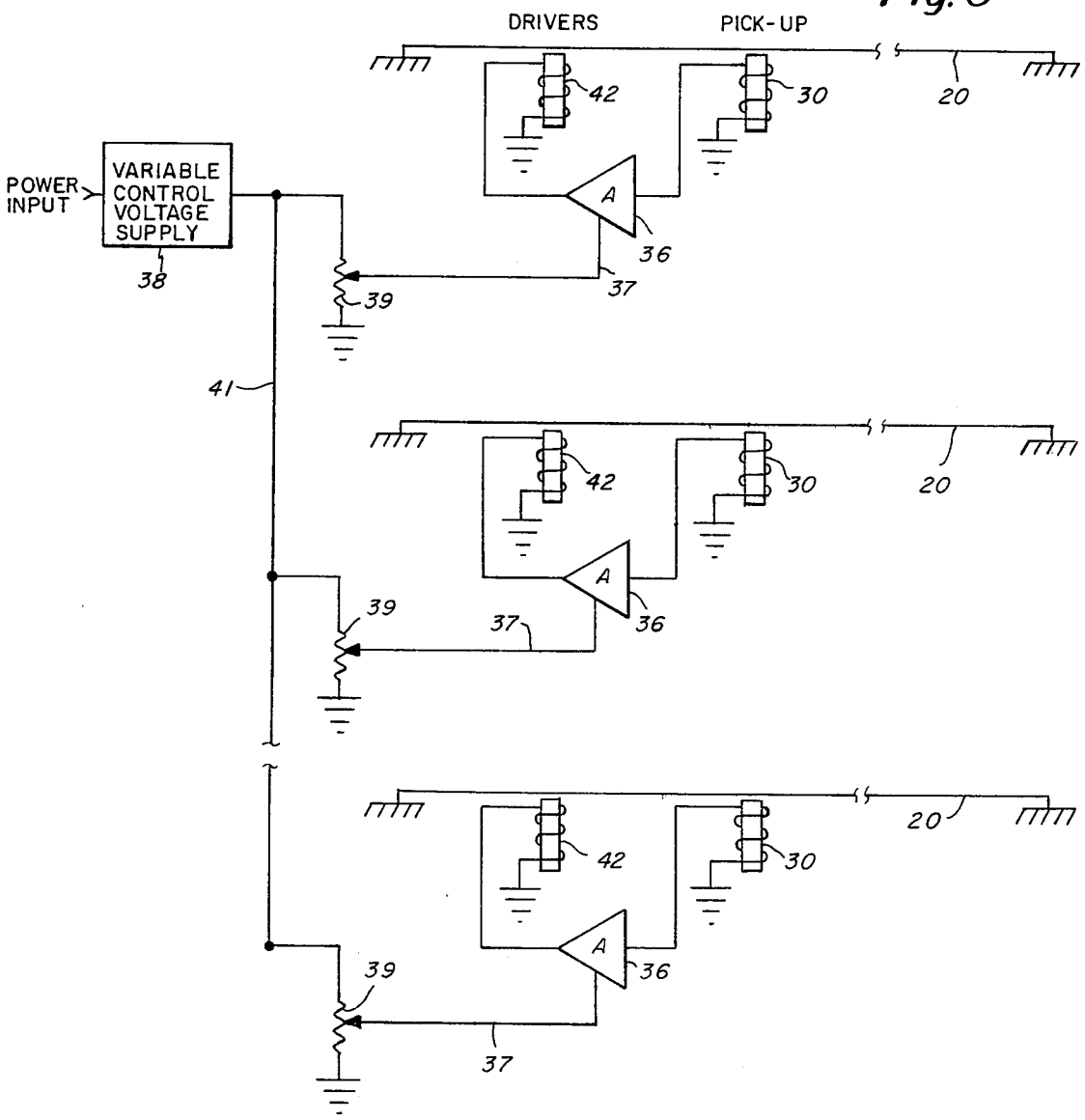

ELECTRIC STRING INSTRUMENT

BACKGROUND OF THE INVENTION

The present invention relates in general to a stringed musical instrument, and preferably an instrument such as a guitar. More particularly, this invention pertains to a musical instrument that has improved means for sustaining the characteristic sound of the instrument.

In the course of a prior art investigation, the following U.S. Patents have been uncovered: Nos. 472,019; 1,002,036; 2,401,372; 3,185,755; 3,524,375; 3,742,113; 4,075,921; and Canadian Pat. No. 461,969. The prior art, as exemplified in, for example the Cohen U.S. Pat. No. 3,742,113 shows a feedback arrangement, that provides a sustenance action. However, this patent and many similar prior art devices cause distortion of the musical sound using such feedback techniques. On the other hand, one of the purposes of the present invention is to provide, in one embodiment disclosed herein, a form of feedback that enhances the natural tone of the sound.

The plane of vibration of a plucked string of an instrument naturally precesses at a relatively slow frequency effecting the tone quality of the instrument. With the use of a conventional drive arrangement such as shown in the Cohen patent the plane of vibration is essentially restricted to a single plane thus effecting the tone quality of the instrument. Accordingly, one object of the present invention in accordance with one version thereof is to provide sustenance means for maintaining string vibration to provide this longitudinal displacement of the string causing natural precession of the plane of vibration of the string.

In the prior art construction such as in the Cohen patent, the feedback arrangement is somewhat complex and requires separate mounting for the pickup and drivers. Also, there is a substantial distance between the pickup and drivers and apparently in this construction the electronics must also be supported separately from the other portions of the feedback loop. To overcome some of these drawbacks of the prior art construction, in accordance with the invention there is provided a common support for the pickup driver and associate electronics, which support also includes means defining a bridge or tail piece from which the strings are mounted. Furthermore, in accordance with the invention there is associated with the driver, a shield means which also provides an improved operation.

SUMMARY OF THE INVENTION

In accordance with the present invention in one embodiment, the stringed musical instrument comprises a body, a plurality of strings, means for mounting the strings to the body at their opposite ends to maintain the strings in tension. The mounting may be conventional at the fingerboard end of the instrument. There is also provided a pickup means associated with each string for receiving a signal proportional to the vibration of its associated string. An amplifier means is also provided and receives the signal from the pickup. This signal is in turn coupled to a driver means associated with the same string and driven from the output of the amplifier means for causing sustaining vibration of the string. In accordance with the invention there is provided common support means for the pickup means, amplifier means and driver means. This common support means includes means defining a bridge over which the opposite end of the string extends and preferably including a tail piece to which the string is affixed. This common support means is mounted at the location of the bridge. For example, with regard to the Cohen patent it could be mounted in place of the bridge 12 shown therein. The pickup means may comprise a pickup coil and similarly, the driver means may include a driving coil with the pickup and driving coils being supported substantially adjacent to each other and each being supported in the common support means. There is also preferably provided a shield means about the driving coil. The common support means in one embodiment includes a plurality of fixed holders, one for each string and essentially forming a tail piece on the common support. Spaced from the tail piece is a bridge member which is adjustable to vary the length of each string. On the other side of the bridge member are provided the pickup and driver coils.

In accordance with this embodiment of the invention the amplifier means are preferably a plurality of gain controlled amplifiers with an amplifier being associated with each string. The gain control input to each of the amplifiers is from a common control means for coupling a common control signal to all amplifiers to thus control their gain essentially in a ganged fashion.

In accordance with another embodiment of the present invention the stringed musical instrument comprises a body, a plurality of strings, and means mounting the strings to the body at their opposite ends to maintain the strings in tension. This mounting means may include a conventional mount for the strings at the finger board end of the instrument. At the opposite end of each string there is the novel control of the present invention. Alternatively, the string mounting control can be provided at the finger board end of the string or possibly even at both ends. There is also provided a pickup means associated with each string for receiving a signal proportional to the vibration of the string. There is also provided amplifier means for receiving the signal from the pickup means. The amplifier means couples to a string control means to which the other end of the string is secured. In this embodiment of the invention there are basically three types of control that can be provided, that is, to provide variable tension in accordance with the amplified signal or to provide variable string length in accordance with the amplified signal or essentially to provide both variable tension and variable string length. Both variable tension and variable string length are provided by an electro-mechanical transducer which may drive an input coil having a plunger associated therewith for causing vibration of the tail piece at a frequency and amplitude proportional to the vibrations that are picked up. In another variation of this embodiment the tail piece may be caused to oscillate while a bridge adjacent thereto is essentially in a fixed position. In this way there is provided a variable tension with a constant string length. In still a last version, the tail piece is fixed and the bridge is caused to longitudinally oscillate, varying the length of the string while retaining the string at constant tension.

In the prior art feedback arrangement such as in the Cohen patent, it is noted that the feedback is to a driver that tend to sustain oscillations in a direction always normal to the body of the instrument. This is not a normal vibration mode and thus this tends to cause distortion. However, in accordance with the present invention the sustaining action is caused by a variable length or tension oscillation of the string, or a variable tension and length oscillation. This action more closely simulates the natural operation of the string. The string control in accordance with the invention sustains the natural plane of vibration which occurs when a string is plucked. This is facilitated by the longitudinal cyclic displacement of the string that causes this natural precession of the plane of vibration.

DESCRIPTION OF THE DRAWINGS

Numerous other objects, features and advantages of the invention should now become apparent upon a reading of the following detailed description taken in conjunction with the accompanying drawings, in which:

FIG. 4 is a further cross-sectional view taken along line 4—4 of FIG. 3;

FIG. 5 is a schematic circuit diagram associated with the embodiment of FIGS. 1–4;

DETAILED DESCRIPTION

Figure 1:
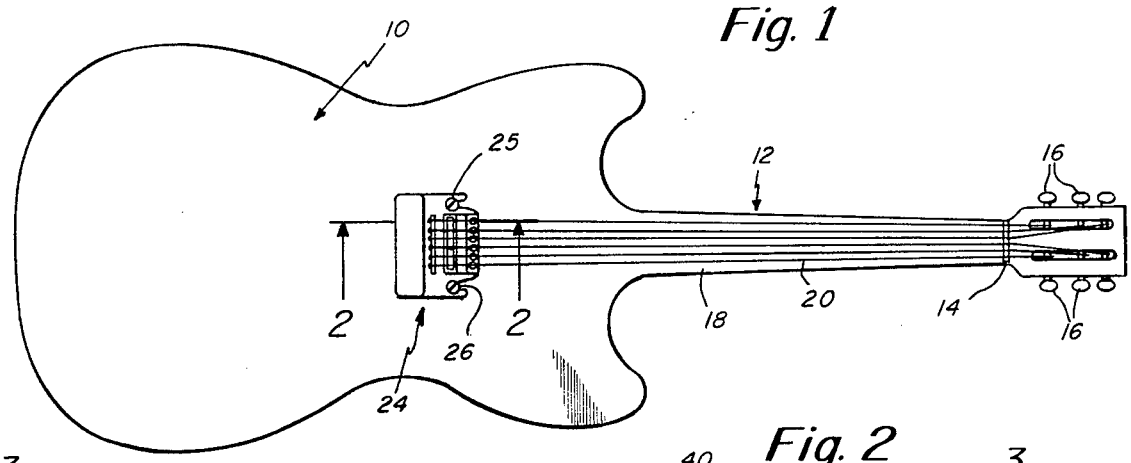
FIG. 1 is a plan view of a guitar depicting one embodiment of the present invention.

FIG. 1 shows a guitar including a body 10, neck 12, a nut 14, and six machines 16. The basic arrangement of the guitar may be conventional including the manner in which the strings 20 are supported at the nut end of the instrument. The strings 20 extend over a finger board 18 and terminate at the opposite end at the device 24. The device 24 is supported in the same position as is the bridge of a conventional guitar. Thus, there are provided support screws 25 and 26 which support the device 24. In a conventional guitar arrangement these screws 25 and 26 are used to support a conventional bridge. In addition, in a conventional guitar there may also be provided a separate tail piece to which the very ends of the strings connect. In this regard it is common for the bridge and tail piece in a conventional guitar to be spaced from each other.

Figure 2:
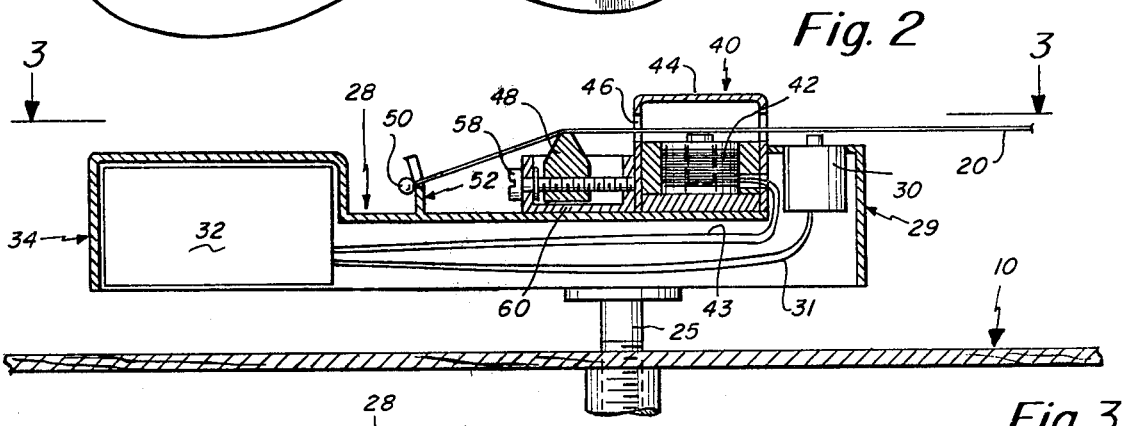
FIG. 2 is a cross-sectional view taken along line 2—2 of FIG. 1 showing the construction of the sustained device of this invention.
Figure 3:
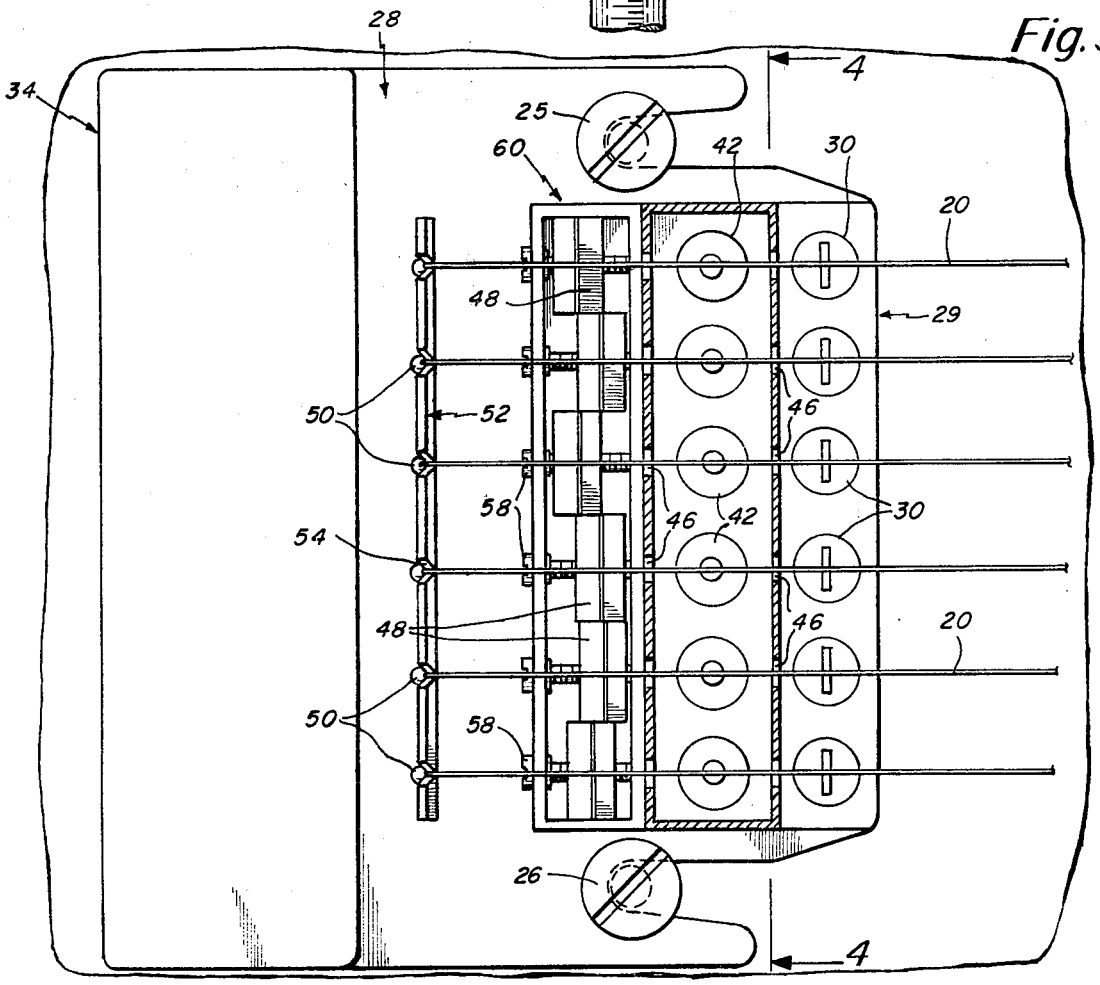
FIG. 3 is a view taken along line 3—3 of FIG. 2 showing further detail of the device of FIG. 2.

The detailed construction of the device 24 is depicted in FIGS. 2–4. This device functions as a bridge, tail piece and sustain device all in one with all of these components being supported from or within a housing 28. The housing 28 may be totally of metal construction or may be partially metallic and partially plastic or the like.

As depicted in FIGS. 2–4 there are six strings 20 each having associated therewith a pickup coil 30 suitably supported at end 29 of the housing 28. The schematic diagram of FIG. 5 also depicts in an electrical sense the pickup coil 30. There are six such coils corresponding to the six strings that are used. FIG. 2 shows leads 31 coupling from the pickup coil to the electronic box 32. The electronic box 32 is contained within the housing 28 at the end 34 and may contain the amplifiers 36 depicted in FIG. 5 along with the variable control voltage supply 38.

On top of and forming a part of the housing 28 is a compartment 40 in which the driver coil 42 is mounted. The upper wall 44 of the compartment 40 forms a shield about the driving coil 42. As noted in FIG. 2 there is shown output leads 43 which also couple to the electronic box 32. FIG. 5 shows electrically the driver coils 42. The compartment 40 is also provided with passages 46 at opposite sides thereof and through which each string 20 extends. The string, after passing through one of the passages 46 extends over the adjustable block 48. The end of each string 20 is provided with an integral fastening ball 50 which is secured in a fixed position in the tail piece member 52. In this regard the tail piece member 52 is provided with 45° notches 54 equally spaced therealong and each accommodating a ball end 50.

The adjustable block 48 essentially forms a separate bridge member for each of the strings. The block 48 is adjustable by means of the associated adjusting screw 58 to incrementally adjust string length. Both the block 48 and the adjusting screw 58 are supported within a U-shaped housing 60. The adjusting screw 58 rotates within the opposite walls of the housing and the only relative movement is between the adjusting screw and the block 48. In FIG. 3 it is noted that the bridge blocks 48 are at different positions relative to the strings 20.

FIG. 5 shows the strings 20 having associated therewith on an individual basis a pickup coil 30 and a driver coil 42. The output of the pickup coil 30 couples to the input of amplifier 36 and the output of amplifier 36 couples to the driver coil. With this feedback arrangement detected vibrations from the pickup coil are amplified and used to drive the driver coil 42 so as to sustain these vibrations. Each one of the amplifiers 36 is preferably a gain controlled amplifier having a control input line 37 connected to a control input thereof. The amplifier 36 is conventional and has its gain altered by means of the voltage level on line 37. For example, the amplifier 36 may comprise an operational amplifier having a typical gain control resistor associated therewith with the line 37 coupling to the gain control resistor circuit for altering the gain of the amplifier. Each of the lines 37 couples to the variable arm of a potentiometer 39. One side of the potentiometer is coupled to ground and the other fixed side of the potentiometer is coupled to a common line 41 which connects to the output of the variable control voltage supply 38. The supply 38 is of conventional design and may simply comprise a variable output voltage supply for varying the voltage level on line 41. Because this output couples in common to all of the potentiometers then the gain of all amplifiers are altered in accordance with the voltage level on line 41 in a ganged or common fashion. In this way, with a single control the magnitude of the sustain can be controlled. Similarly, individual control can be provided by adjustment of each of the individual potentiometers 39.

In this first embodiment of the invention it is noted that there are no separate mounting required for the driver and pickup coils. There is provided essentially a single housing that accommodates both of these coils for each string and also a means for securing the string to the housing with adjustment means associated therewith. Furthermore, within the housing there is provided all of the necessary electronics and control. In addition, the compartment 40 for the driver is arranged to have an upper shield wall so as to prevent any high level electro-magnetic waves emanating from the driver from interfering with the guitar pickups. This shielding arrangement also prevents direct magnetic feedback occasioned by the close proximity between the pickup and driver.

Figure 6:
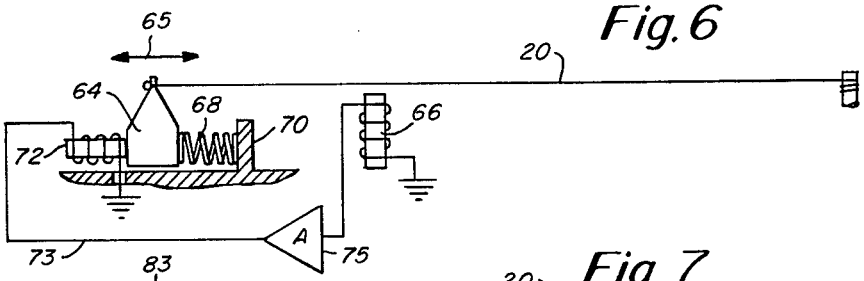
FIGS. 6–8 show schematically three alternate versions of another embodiment of the invention including a feedback loop for controlling each string individually to vary its length or tension, or both in a longitudinally oscillating manner.
Figure 7:
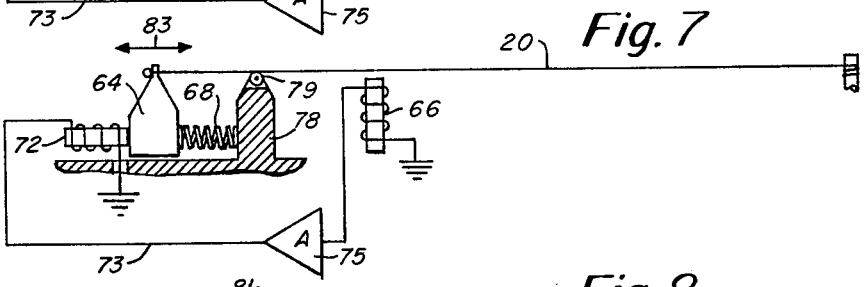
Figure 8:
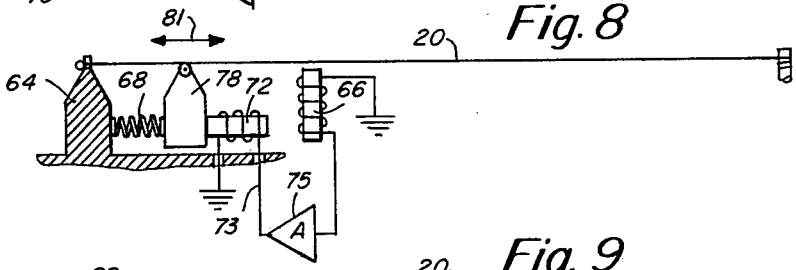
Figure 9:
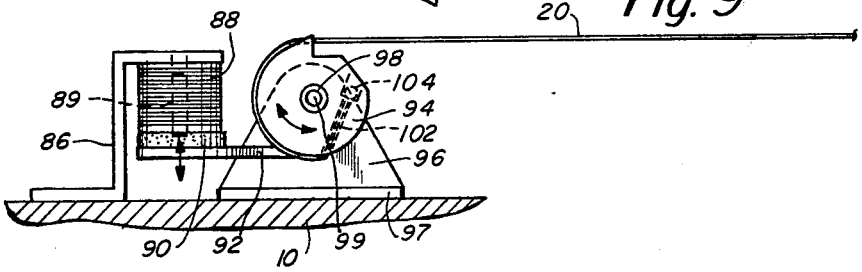
FIGS. 9 and 10 show a specific embodiment of an electro-mechanical means for implementing the string longitudinal oscillations.
Figure 10:
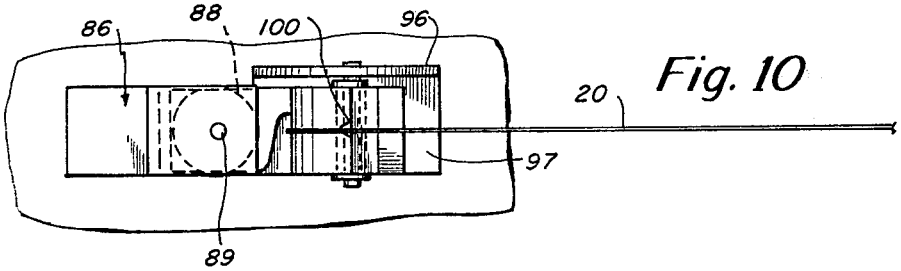

The second embodiment of the invention is disclosed in FIGS. 6–10. FIGS. 6–8 are schematic type representations while FIGS. 9 and 10 show one actual embodiment that may be employed. In the first embodiment of the invention the string is caused to sustain its vibrations by means of a driver coil, that essentially sustains vibrations in a direction normal to the body of the instrument. However, in the second embodiment it has been found that more natural sustaining action can be provided by varying either string tension or length, or both in an oscillating manner, not normal to the length of the string. Thus, in the embodiment wherein both length and tension is varied, as depicted in FIG. 6, the anchor member 64 is caused to oscillate at a frequency corresponding to that detected by the pickup coil 66. The anchor member 64 may be caused to oscillate at the same frequency as that detected or can be caused to oscillate at different frequencies such as twice the detected frequency. The string 20 in FIG. 6 is shown attached to a top end of the anchor member 64. This may be attached by means of a groove in the top of the member 64 engaging with the ball end of the string. The member 64 is suitably supported in guide ways (not shown) and is free to oscillate in the direction of arrow 65. On one side of the member 64 there is disposed a spring 68 which is fixed at one end to the fixed support 70. On the other side of member 64 there is provided the driver coil 72 which converts the electrical input signal on line 73 into a mechanical motion of the anchor member 64. The feedback loop also includes the amplifier 75 which has its input coupled from the pickup coil 66 and its output coupled to the driver coil 72 by way of line 73.

Thus, in the embodiment of FIG. 6 as the pickup coil 66 detects a vibration of the string 20, this signal is amplified by amplifier 75 and proportional signal drives the driver coil 72 causing oscillation of the anchor member 64 in the direction of arrow 65. As mentioned previously, this sustaining action this creates a more natural tone more like the tone that is initially created when the string is manually plucked (vibrated).

FIG. 7 shows another embodiment of the present invention using many of the same components described in FIG. 6 with the addition of a bridge member 78 which is fixed in position and thus maintains the length of the string at a constant. It is noted that the very top end 79 of the bridge contacts the string 20 and this point remains at a fixed distance from the nut. In this embodiment of FIG. 7 the feedback operation is substantially the same as in the embodiment of FIG. 6 except that the length is maintained constant and only the string tension is varied by longitudinal oscillation of member 64.

FIG. 8 shows a third version of the invention wherein the anchor member 64 is fixed in position and the bridge member 78 instead is caused to oscillate under control of the driver coil 72. In FIG. 8 it is noted that the driver coil 72 is shown as schematically disposed on the opposite side of the bridge 78. The spring 68 in this version extends between member 64 and 78. In FIG. 8 the arrow 81 depicts the motion of the member 78. Similarly, in FIG. 7 the arrow 83 depicts the motion of the member 64.

FIGS. 9 and 10 depict a more detailed version of the second embodiment of this invention and in particular the version shown in FIG. 6 wherein both string length and tension are varied to provide the sustaining characteristic. In FIGS. 9 and 10 the sustaining device is shown secured to the body 10 of the guitar, and includes a support frame 86 which is fixed to the body and supports the driver coil 88. The driver coil 88 includes a center pole piece 89 and an elastic material 90 disposed between the bottom of the driving coil and the plate 92. The plate 92 is supported tangentially from the support member 94 which is predominantly of cylindrical shape. The rotatable member 94 is supported in rotation from the support member 96 which has a base 97 supported from the body 10. The base 97 may be secured to the body 10 in a conventional manner. The rotating member 94 is supported on a bushing 98 which in turn rotates on the shaft 99 which is fixed to the upright support 96. The string 20 extends about the periphery of the support member 94 and is centered in a guide slot 100 so that the string 20 does not move laterally. The end of the string then extends through a passageway 102 in the rotating member and the ball end 104 is locked relative to the rotating member in a suitable groove or notch therein.

When the string 20 is taut then the rotating member is biased in a clockwise direction as viewed in FIG. 9. The plate 92 compressing the elastic material 90. The coil 88 is operated from the output of an amplifier as in the arrangement of FIGS. 6–8. This output electrical signal drives the coil 88 to provide an oscillation of the plate 92 which in turn causes oscillation of the string 20.

Figure 11:
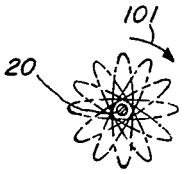
FIG. 11 schematically illustrates the precession of the plane of vibration of a naturally vibrating string.

The schematic diagram of FIG. 11 is useful in explaining the principles of the embodiment of FIGS. 6–10. FIG. 11 illustrates the precession of the plane of vibration of the string. This precession is at a slow rate relative to the string frequency but nonetheless effects the tone quality of the instrument. When a string is plucked this natural precession occurs with the oscillation occurring in a plane that rotates relatively slowly such as in the direction of the arrow 101 of FIG. 11. When the string vibration is restricted from this rotational plane of vibration precession, then there is considered to be a distortion of the instrument's natural sound. This is what occurs when a conventional electro-magnetic driver is used such as in the Cohen patent referred to hereinbefore. With regard to the diagram of FIG. 11 this type of operation is an operation that would be restricted to essentially a single plane of oscillation without precession such as a vertical plane of oscillation of the string 20 in FIG. 11. However, in accordance with the present invention the string is not driven in the conventional manner but is driven essentially longitudinally in line with the string itself, thus tending to sustain a more natural string vibration in a plane parallel to the string and which precesses in the manner illustrated in FIG. 11.

With the conventional driver arrangement such as shown in the Cohen patent, the driver tends to sustain and amplify only harmonics that have a maximum near the position of the driver. Any harmonics with a node near the driver will not be amplified. Thus, the prior art driver arrangement provides a distorted sound unlike the natural frequency sound. However, in accordance with the present invention by driving the string longitudinally there is a more natural vibration characteristic of the spring without a sensitivity to the position of the driver as is characteristic in the prior art arrangement.

Having described a limited number of embodiments of the present invention, it should now be apparent to those skilled in the art that numerous other embodiments are contemplated as falling within the scope of this invention. For example, in the first disclosed embodiment, both the bridge and tail piece are mounted on the common support. However, in an alternate arrangement the tail piece could be mounted separately and rearwardly of the common support. In this way the string is anchored rearwardly of the common support but is contacted by the bridge member at the common support.

What is claimed is:

1. A stringed musical instrument comprising;
a body having a neck,
a plurality of strings,
means mounting the strings to the body at the neck to thus support one end of each string,
a pickup means associated with a string for receiving a signal proportional to the vibration of the string,
amplifier means receiving said signal,
driver means also associated with the string and driven from said amplifier means for causing a sustaining vibration of the string,
common support means for the pickup means, amplifier means and driver means and including means defining a anchor means for the opposite ends of the strings to maintain the strings in tension and means defining a bridge disposed spaced along the strings from the anchor means,
and means securing the common support means from the instrument body.

2. A stringed musical instrument as set forth in claim 1 wherein said pickup means includes a pickup coil and said driver means includes a driving coil, said pickup and driving coils being supported adjacent to each other.

3. A stringed musical instrument as set forth in claim 2 including shield means about the driving coil.

4. A stringed musical instrument as set forth in claim 1 wherein said support means comprises a support housing.

5. A stringed musical instrument as set forth in claim 1 wherein said means defining a bridge includes means for adjusting the longitudinal position along each string of the bridge.

6. A stringed musical instrument as set forth in claim 1 wherein said amplifier means includes a gain-controlled amplifier.

7. A stringed musical instrument as set forth in claim 6 including a plurality of amplifiers, one associated with each string and common control means for coupling a common control signal to the amplifiers to control the gain thereof in a ganged fashion.

8. A stringed musical instrument comprising;
a body having a neck,
a plurality of strings,
means mounting the strings to the body at the neck to thus support one end of each string,
a pickup means associated with a string for receiving a signal proportional to the vibration of the string,
amplifier means receiving said signal and providing an amplified control signal related in frequency to the string vibration frequency,
means for supporting the opposite ends of the strings to maintain the strings at a quiescent tension,
and string control means for providing a natural sustaining action responsive to said control signal for longitudinally displacing said string support means in phase with the detected string vibration signal.

9. A stringed musical instrument as set forth in claim 8 wherein the string control means includes tail piece means for holding an end of the string and causing longitudinal displacement of the string in accordance with the control signal from the amplifier means to vary both the length and tension of the string on an oscillating basis.

10. A stringed musical instrument as set forth in claim 8 wherein the string control means includes a tail piece means for holding an end of the string and causing longitudinal displacement of the string in accordance with the control signal from the amplifier means and a fixed position bridge means, said longitudinal oscillation varying string tension with constant string length musically.

11. A stringed musical instrument as set forth in claim 8 wherein the string control means includes a fixed tail piece means for holding an end of the string and bridge means causing longitudinal displacement of the string in accordance with the control signal from the amplifier means to vary string length with constant string tension.

12. A stringed musical instrument as set forth in claim 5 wherein said means defining a bridge includes separate block means, one associated with each string and each being individually adjustable.

13. A stringed musical instrument as set forth in claim 8 wherein said longitudinal displacement causes a slight oscillating variation in string length to sustain a natural string vibration in a plane parallel to the string and rotationally precessing.

14. A stringed musical instrument as set forth in claim 8 wherein said longitudinal displacement causes a slight oscillating variation in string tension to sustain a natural string vibration in a plane parallel to the string and rotationally precessing.

15. A stringed musical instrument as set forth in claim 8 wherein said string vibrations are manually induced.

* * * * *